United States Patent [19]

Hayes

[11] 4,248,420

[45] Feb. 3, 1981

[54] DYNAMIC SELF-RESISTING EXERCISE CHAIR

[75] Inventor: Thomas J. Hayes, New York, N.Y.

[73] Assignee: Blazon-Flexible Flyer, Inc., West Point, Miss.

[21] Appl. No.: 9,843

[22] Filed: Feb. 6, 1979

[51] Int. Cl.[3] ..... A63B 21/00

[52] U.S. Cl. ..... 272/126; 297/433

[58] Field of Search ..... 272/126, 134, 136, 142, 272/144, 146, 143, DIG. 4; 128/25 R, 25 B; 297/68, 434, 433, 429

[56] References Cited

U.S. PATENT DOCUMENTS

| | | | |
|---|---|---|---|
| 3,000,632 | 9/1961 | Fuchs | 272/126 X |
| 3,072,400 | 1/1963 | Dykinga | 272/134 X |
| 3,117,782 | 1/1964 | Johnston | 272/144 X |
| 4,136,868 | 1/1979 | Hogue | 272/144 |

FOREIGN PATENT DOCUMENTS

| | | | |
|---|---|---|---|
| 83466 | 11/1895 | Fed. Rep. of Germany | 272/117 |

*Primary Examiner*—William R. Browne

[57] ABSTRACT

An exercise chair having a body-supporting frame 15, a support member 17 pivoted on the frame to support the frame in inclined position and having a seat 19, and a footrest 21 swiveled on the base of the frame for swinging toward and away from the frame. A rope 29 trained over pulleys 26, 27 and 58 connects a crossbar 23 on the top of the frame 15 to the footrest 21 for transmitting a pulling force applied to the ends of crossbar 23 to the footrest 21 to swing it rearwardly toward the frame.

14 Claims, 11 Drawing Figures

55
29
26
23
56
28
16'
16
8
8
34'
5
56
23
25
27
35
36
32
15
29a
28
46'
46
58
60
59
42b
19
42c
6
6
17
43
42
18
50
49
48
49
50
38
32b
5
9
9
40
22a
29
21
21
22b
52
53
30
22c

DYNAMIC SELF-RESISTING EXERCISE CHAIR

TECHNICAL FIELD

This invention relates to exercising equipment for exercising and strengthening the muscle groups of the human body, thereby conditioning the body and stimulating cardiovascular therapy.

BACKGROUND ART

Prior exercising equipment includes weights for lifting, stationary bicycles, rowing machines, and the like, all of which incorporate selected amounts of resistance against which one must apply his muscles to build up and strengthen them. In using such equipment, particularly in weight lifting, there is danger of injury to the muscles in attempting to lift too much weight, and this is especially true where rehabilitation of an injury is being attempted. Moreover, there is always danger of dropping the weights on parts of one's body such as the feet.

Another disadvantage in the use of such equipment is that, because the condition of the body varies from day to day, the amount of weight or resistance selected or set for one day may be excessive for another day, resulting in discouragement, frustration, and possibly bodily injury.

Exercising equipment such as stationary bicycles is very effective for strengthening the leg muscles, provided that the resistance is not set to an excessive amount, but one must then do something else, use another piece of equipment, to exercise the arms and other parts of the body.

Certain other pieces of exercising equipment utilize weights, overhead heavy metal plates and bars, rubber ropes, springs, benches and power-driven machines, all of which are apt to be dangerous and are so costly that they are usually available only in professional gymnasiums.

There are isometric exercises, in which parts of the body are applied against the resistance of an immovable object such as a wall or floor, or one set of muscles is applied statically against another set. In order for such exercises to become effective, a great deal of time, practice and patience is required.

Also, there are rope and pulley devices wherein ropes connect the hands and feet in an attempt to balance the arm muscles against the leg muscles, but such devices are adapted to be attached to a door knob while the body occupies strained and uncomfortable positions on the floor. Moreover, there is always a danger of injury due to the door knob breaking loose under the pulling and twisting forces exerted thereon.

DISCLOSURE OF INVENTION

The present novel exercising chair is constructed to utilize the resistance of one's legs, normally the strongest parts of the body, working dynamically against the arms and other parts of the upper body, to provide a controlled amount of resistance related to the body condition.

It is an object of the present invention to provide a novel inexpensive exercising chair in which all parts of the body may be rapidly and simultaneously exercised, and strengthened, thereby stimulating cardiovascular therapy.

Another object of the present invention is to provide a novel exercising chair having foot supporting means hinged thereon for flexing an occupant's legs, and flexible means connecting said foot supporting means to the occupant's arms so as to apply the strength of the arms against the resistance of the legs.

A further object is to provide a novel exercising chair which is quickly and easily folded, transported and stored.

Another object is to provide a novel exercising chair which is completely safe and requires no weights, springs and other resilient parts, or power-driven parts.

A still further object is to provide a novel and inexpensive chair device in which the occupant may perform all of the classic dynamic exercises, such as rowing, military press, curl, front lateral raise, pullover and butterfly, while utilizing only the controlled resistance supplied by the occupant's legs.

PREFERRED EMBODIMENT FOR CARRYING OUT INVENTION

Figure 1:
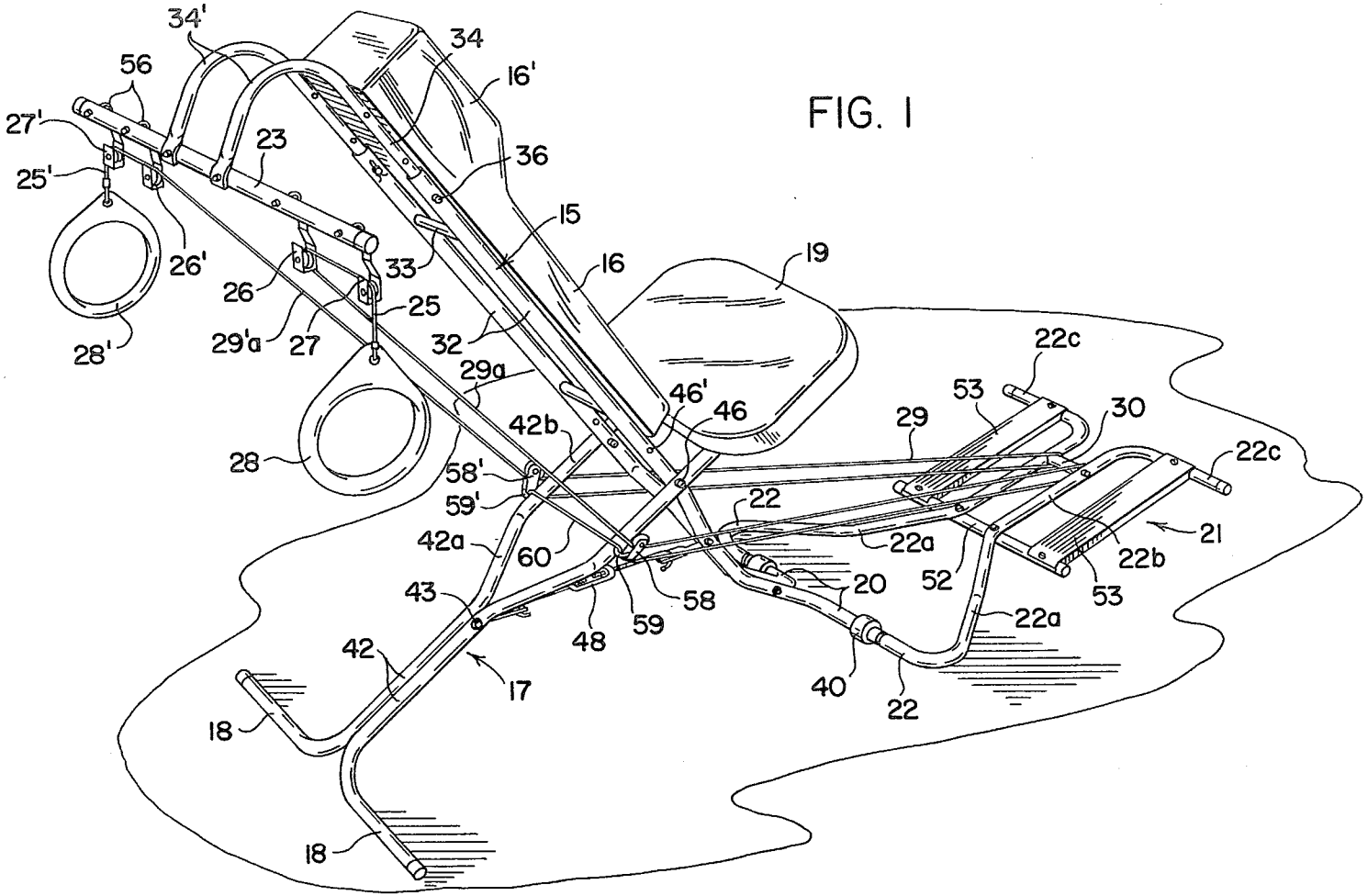
FIG. 1 is a rear perspective view of the novel exercising chair.

Referring first to FIG. 1, the novel chair comprises a frame indicated generally at 15, on which a back and head rest indicated at 16 and 16' is mounted, the frame being supported in inclined position by a support member indicated generally at 17 pivoted on the frame and having bottom feet 18 resting on the floor and a seat 19 on its upper end. The bottom end of the frame has outturned transverse legs 20 resting on the floor and the footrest indicated generally at 21 has rear transverse legs 22 swiveled in legs 20. A crossbar 23 is adjustably mounted on the upper end of the frame.

The flexible means connecting the footrest 21 to the arms of an occupant of the chair comprises a rope having its end portions 25 and 25' trained over pulley blocks 26 and 27 and 26' and 27' on crossbar 23 and terminating in handle rings 28 and 28', the medial portion 29 of the rope being looped around a central transverse bar 30 on footrest 21.

Figures 2, 7:
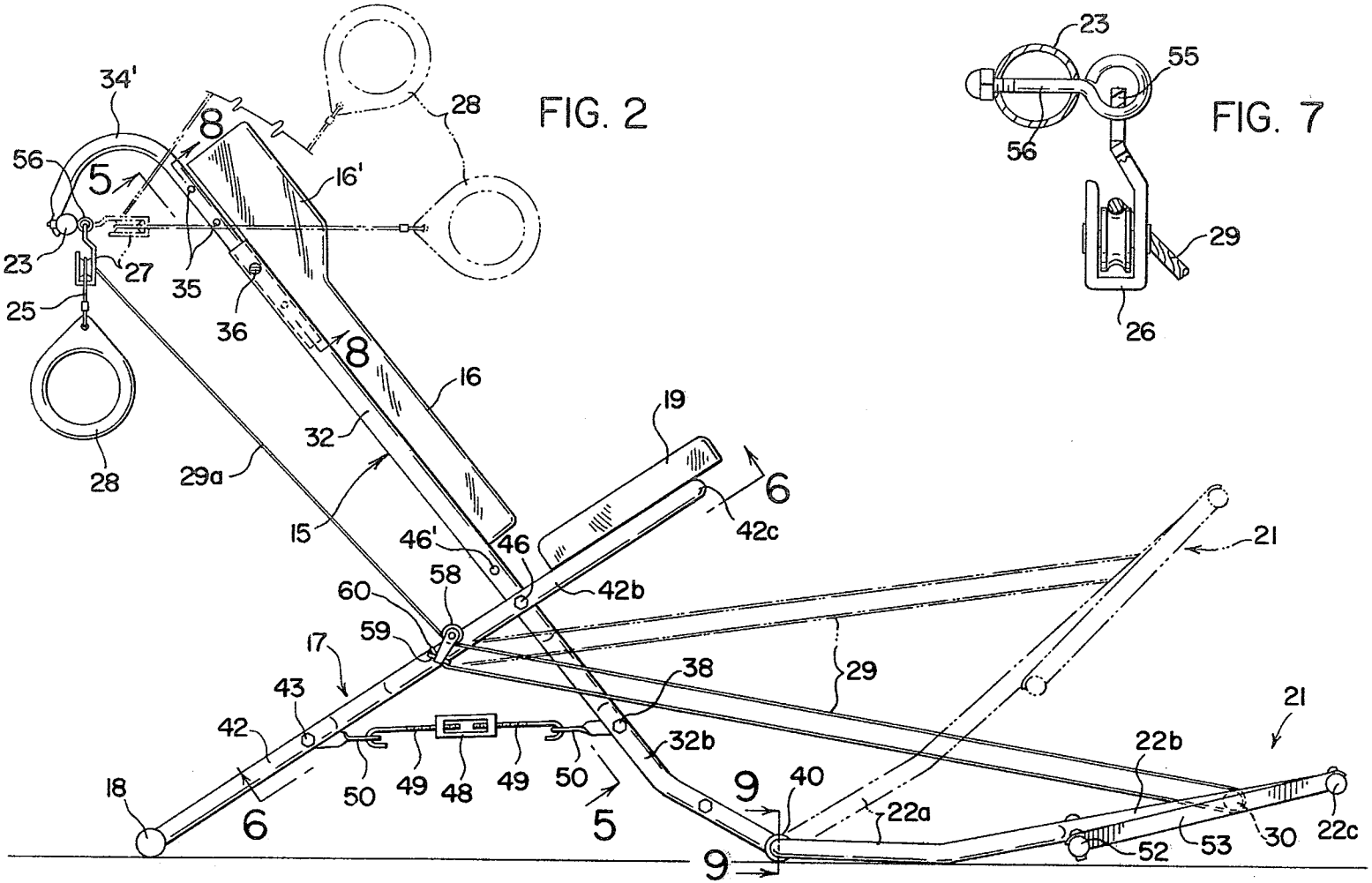
FIG. 2 is a side elevation thereof, showing different positions of the hand handles and the foot support in phantom.
FIG. 7 is an enlarged side elevation, partly in section, showing one of the pulleys mounted on the upper crossbar.
Figure 8:
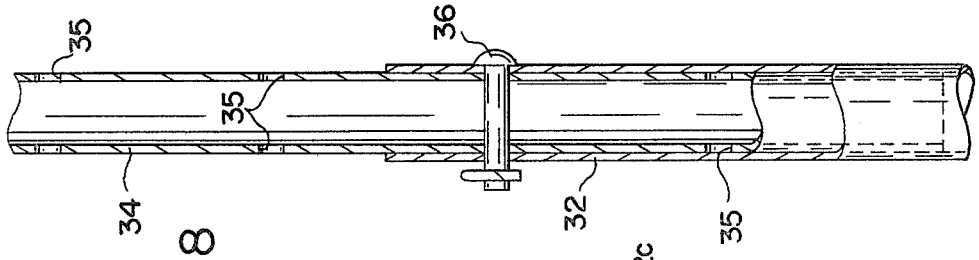
FIG. 8 is an enlarged partial sectional view showing the adjustable mounting of the tubes of the upper crossbar in the tubes of the frame.
Figure 5:
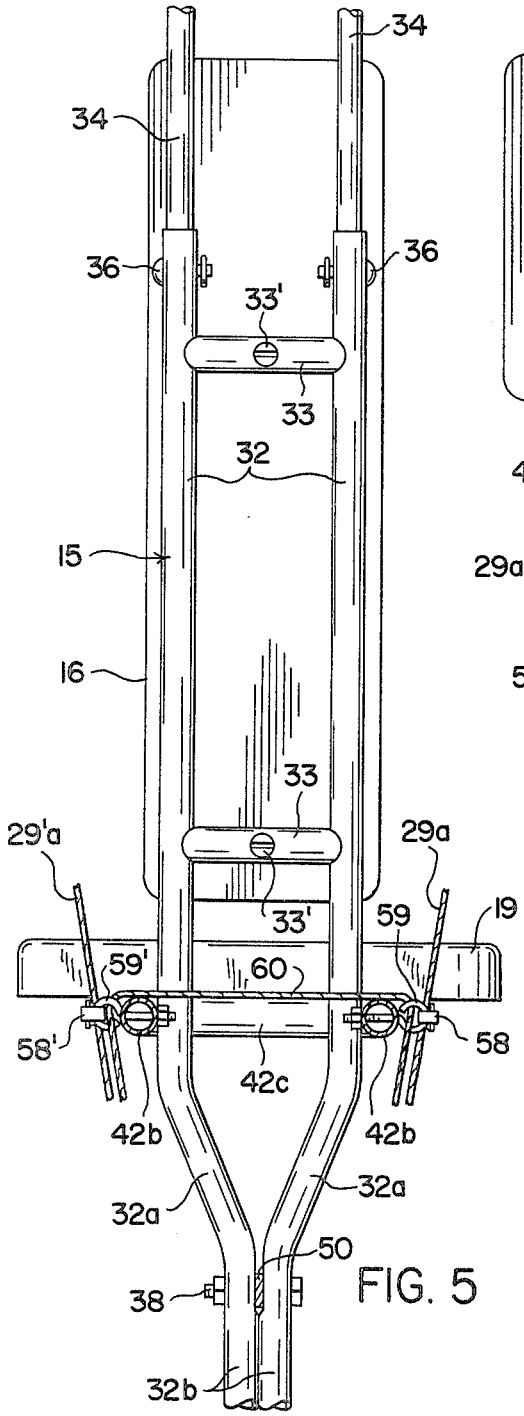
FIG. 5 is an enlarged rear elevation of the medial portion of the frame, showing the frame-supporting member in section.

As shown in FIGS. 5 and 8, the frame 15 is preferably formed by two parallel tubular bars 32 which are connected in laterally spaced relation by crossbars 33 welded at their ends to the bars 32. The backrest 16 may be secured to bars 33 by screws 33'. The upper ends of bars 32 are adapted telescopically to receive the lower ends of bars 34 of smaller diameter having longitudinal series of transverse holes 35 therein (FIG. 2) for adjustably mounting the bars 34 in bars 32 by means of bolts 36 inserted through both the bars 32 and bars 34.

As shown in FIGS. 1 and 2, the upper portions 34' of bars 34 are curved rearwardly and downwardly, and are secured at their lower ends to the medial portion of the crossbar 23.

Figure 4:
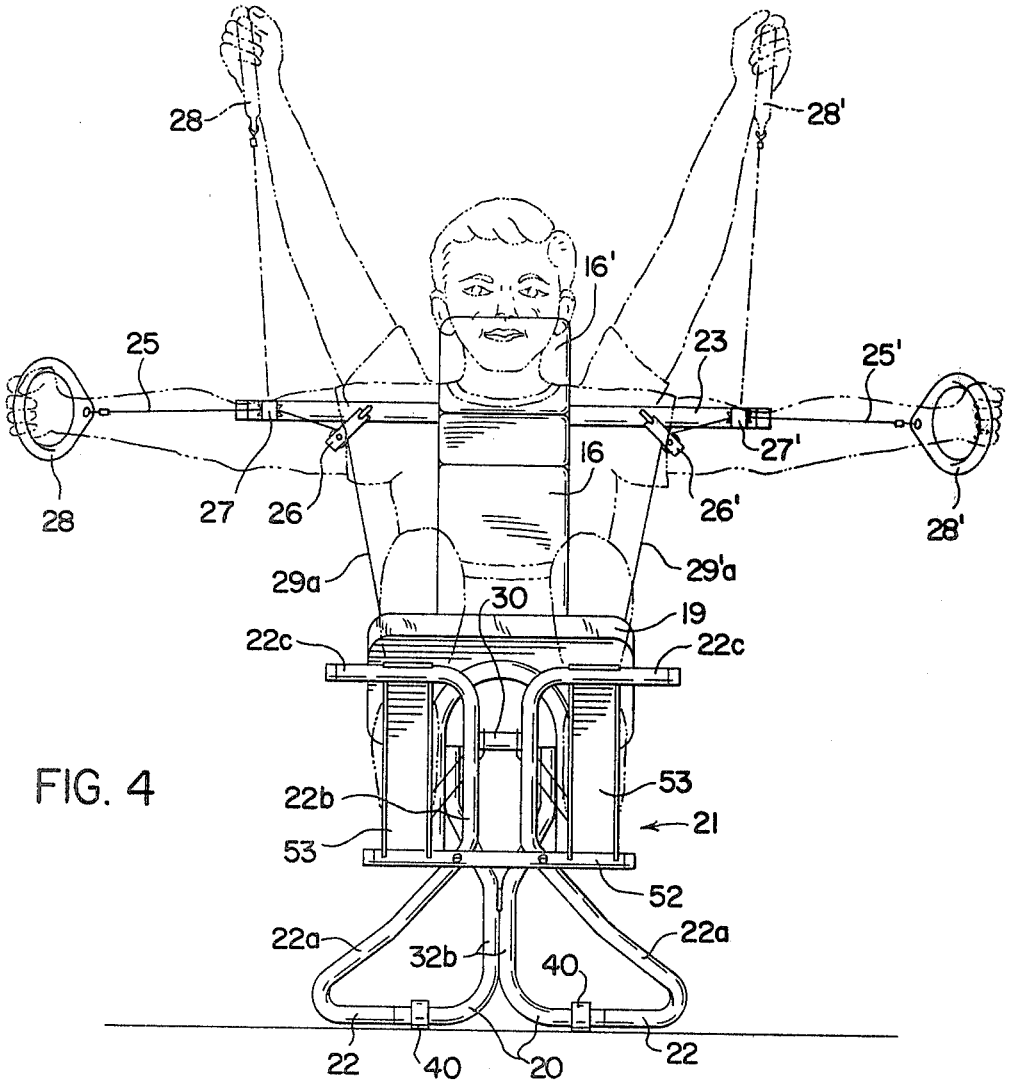
FIG. 4 is a front elevation showing a person seated in the chair in exercising positions.
Figure 9:
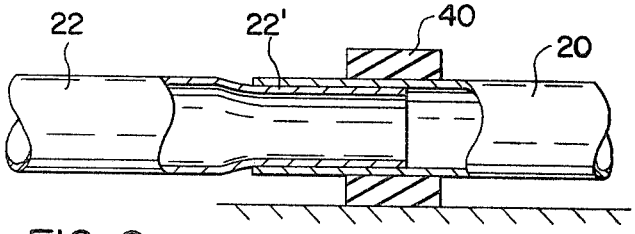
FIG. 9 is an enlarged partial sectional view showing how the transverse rear legs of the foot support are swiveled in the transverse bottom legs of the frame.

Referring to FIGS. 4 and 5, the lower portions of frame bars 32 are inclined toward each other at **32*a* and have downwardly extending portions 32*b* secured together by bolts 38. The bottom ends of bars 32*b* have transversely outturned legs 20 forming a base and the legs 20 telescope over the ends 22' of rear legs 22 of the footrest, the ends 22' being necked in to swivel-fit into the transverse legs 20 of the frame, as best shown in FIG. 9. Preferably, the telescopic swivel joints between legs 20 and 22 are supported above the floor level by collars 40** to facilitate the swiveling action.

Figure 6:
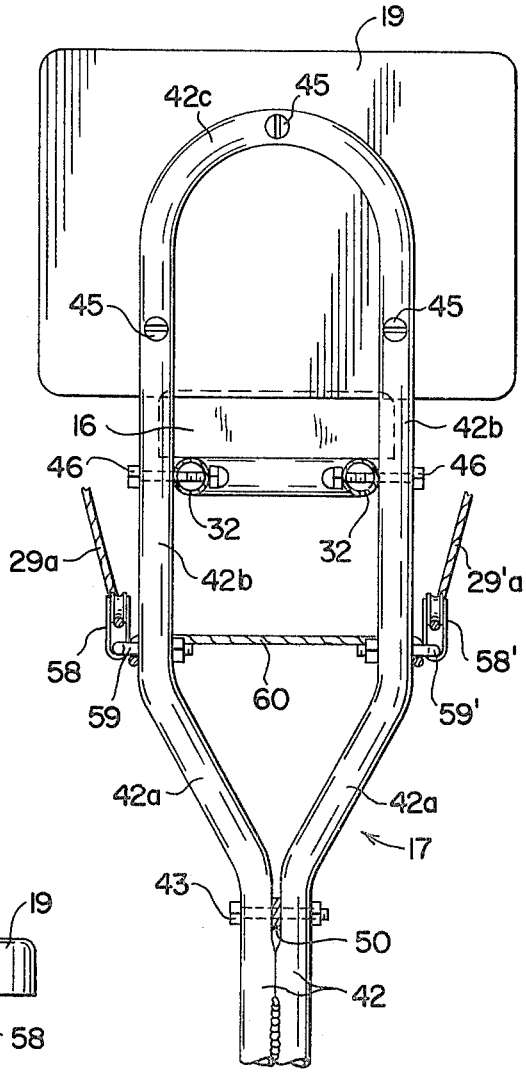
FIG. 6 is an enlarged partial bottom elevation of the frame supporting member.

As best shown in FIGS. 1, 2 and 6, the support member 17 has two lower parallel portions 42 bolted together by bolt 43 and terminating in the transversely outturned legs 18 adapted to rest on the floor. Above the bolt 43 the bars are inclined away from each other at **42*a* and then merge into laterally spaced parallel portions 42*b* joined together at their upper ends by a curved portion 42*c* on which the seat 19 is mounted by screws 45. The portions 42*b* are spaced apart sufficiently to straddle the bars 32 of the frame immediately below the bottom of backrest 16 and are pivotally connected to the bars 32 by bolts 46. Additional holes 46' may be provided in the bars 32 to change the location on the frame of pivot bolt 46**.

As shown in FIGS. 1 and 2, a turnbuckle 48 has bolts 49 with hook ends engaged in rings 50 bolted to the bars **32*b* of the frame and the bars 42 of the support member to adjustably limit the rearward swinging movement of the support member and adjust the inclination of the frame 15**.

Referring to FIGS. 1 and 4, the footrest 21 is preferably formed by two bars having the transverse legs 22 at their rear ends and curving laterally outward and forwardly therefrom to merge into portions **22*a* inclined toward each other, and then merging into parallel forwardly extending portions 22*b* which terminate in outturned transverse legs 22*c*. The central transverse bar 30 is connected at its ends to medial parts of portions 22*b* and a crossbar 52 is secured to the rear ends of portions 22*b* and extends laterally outward therefrom. Flat footrest bars 53 parallel to the portions 22*b* are secured at their ends to crossbar 52 and legs 22*c*, and are preferably spaced laterally outward of portions 22*b***.

The rope 29 connecting the upper crossbar 23 with the footrest 21 is preferably one continuous length, one end 25 being connected to one handle ring 28 and normally trained over pulley blocks 26 and 27 on one end of crossbar 23 and the other end 25' trained over pulley blocks 26' and 27' on the opposite end of the crossbar. As shown in FIG. 7, these pulley blocks are preferably open at the top to facilitate inserting and removing the rope and have perforate flanges 55 loosely mounted on the circular ends of eye bolts 56 extending through and journaled in the crossbar 23. Thus, the pulley blocks are mounted for substantially universal movement.

From pulley 27 the rope 29 may extend downwardly at **29*a* to pass through a pulley block 58 mounted for substantial universal movement on an eye bolt 59 on the bar 42*b* on the same side of the frame (FIG. 6), and then extends forwardly to snub around bar 30 on the footrest and return to the location of pulley block 58. At that location the rope passes through the eye of bolt 59 secured on the bar 42*b* and then extends at 60 across the backs of bars 42*b* through an eye bolt 59' on the opposite bar 42*b*. From eye bolt 59' the rope extends forwardly to snub around bar 30 and return to pass through pulley block 58' mounted on eye bolt 59' and thence upward at 29'*a* and through pulley blocks 26' and 27' to handle 28'. Thus the rope strands 29*a* and 29'*a* extending between pulley blocks 26 and 58 and between pulley blocks 26' and 58' are always spaced inwardly from the outer ends of crossbar 23 to avoid interference with manipulation of the handles 28 and 28' and rope ends 25 and 25'**.

Figure 3:
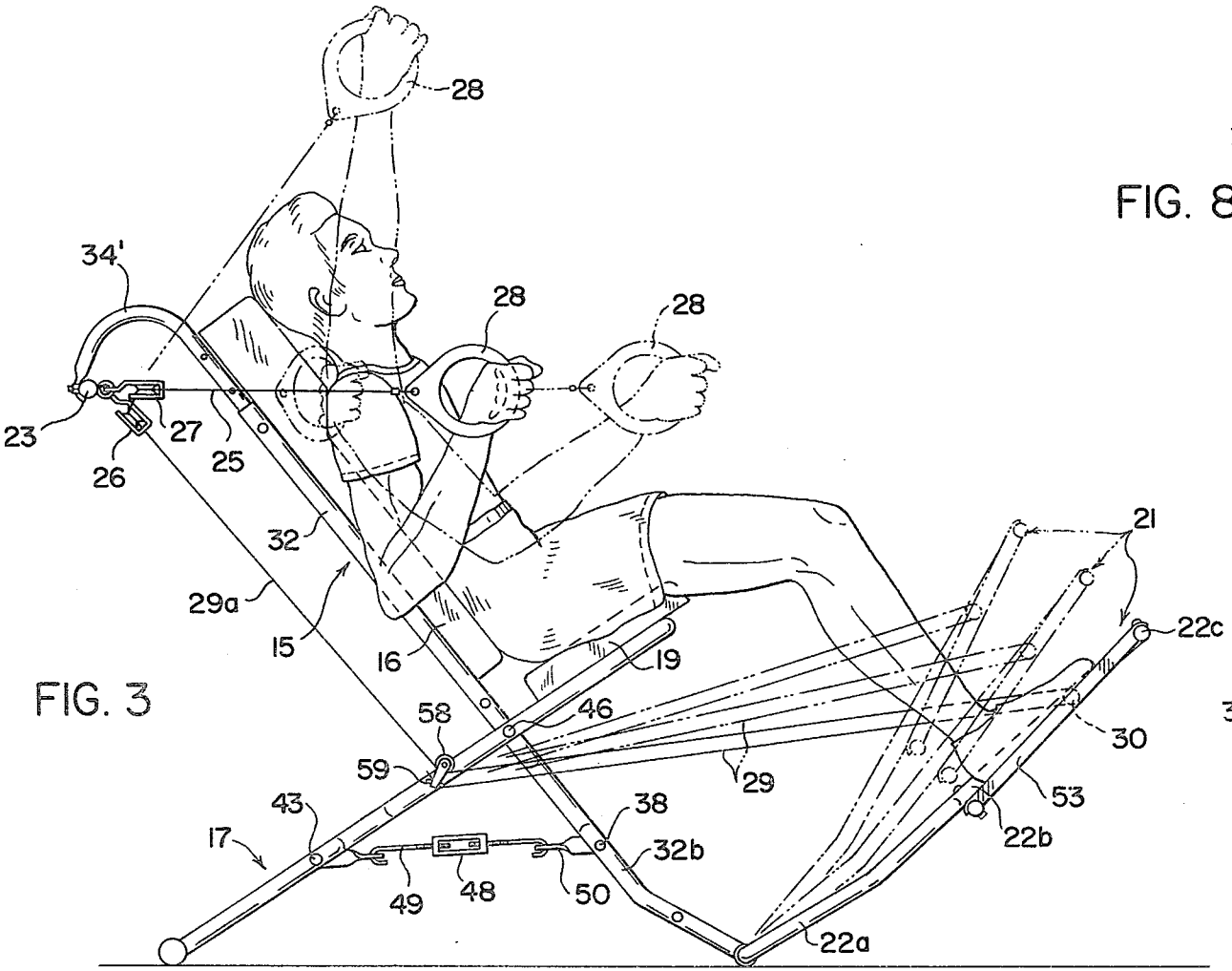
FIG. 3 is a similar view showing a person seated in the chair in exercising positions.

Referring to FIGS. 3 and 4, the occupant of the chair is shown in various positions while carrying out various standard dynamic exercises, such as the butterfly, pullover or military press, during all of which exercises the pull of the arms is balanced by the controlled resistance of the pressure of the legs on the footrest.

Figure 10:
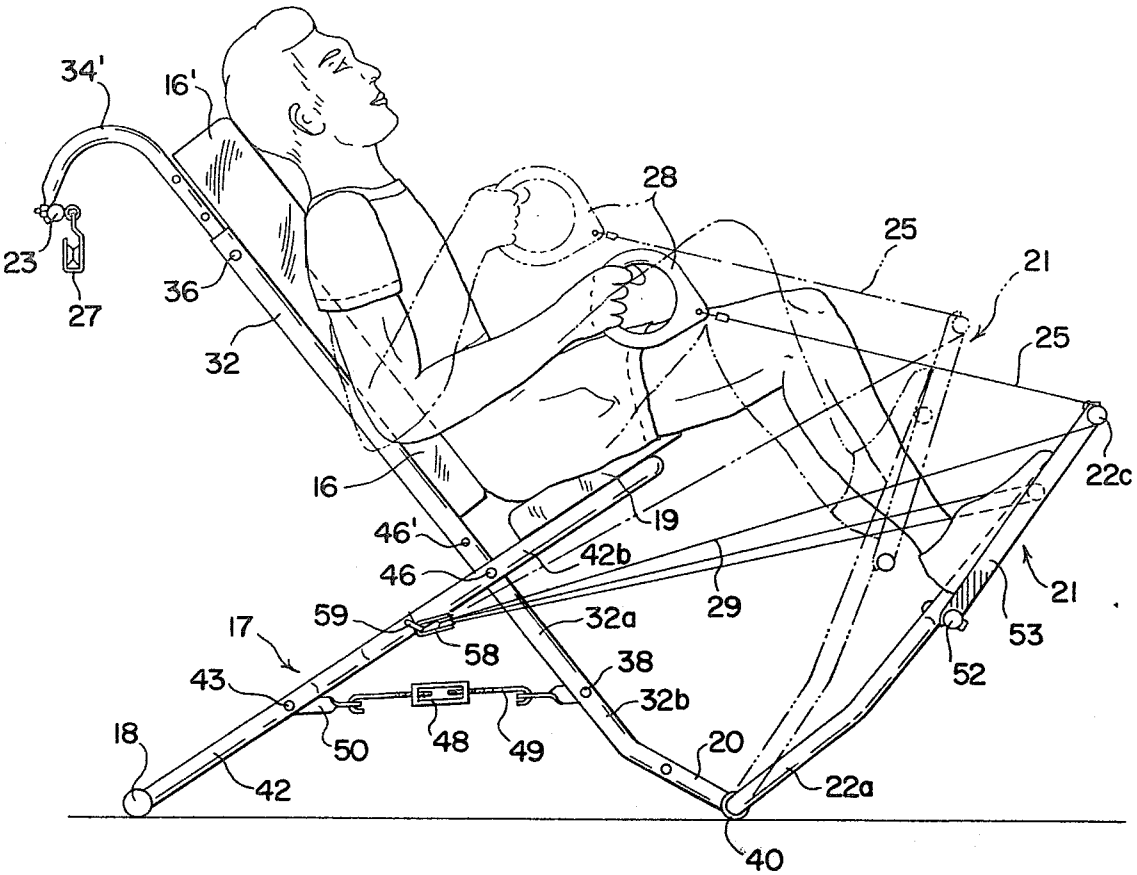
FIG. 10 is an elevation similar to FIG. 3, showing how the novel chair is adapted for use in performing various dynamic exercises.

FIG. 10 shows how the rope arrangement can be easily modified to facilitate carrying out certain other standard exercises such as the curl and the front lateral raise. In this case the end strands 25 and 25' of the ropes adjacent the handles are removed from the open pulley blocks 26,27 and 26',27' and carried forward and snubbed around the outer ends of bars **22*c* of the footrest 21**. Two positions of the occupant are shown while carrying out exercises using this modified rope arrangement.

Figure 11:
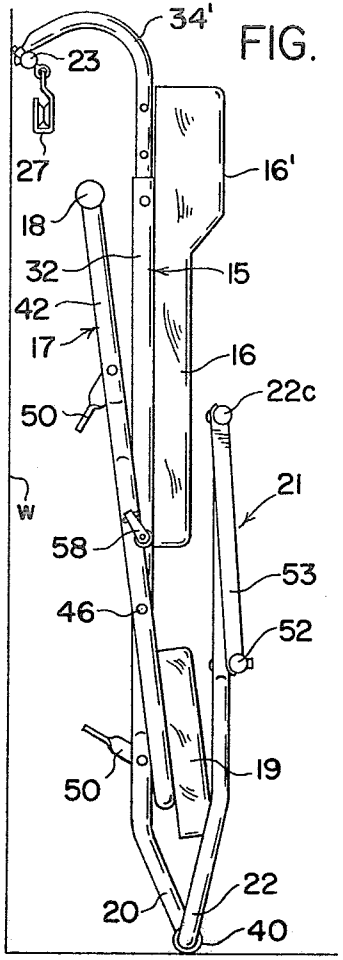
FIG. 11 is a side elevation showing the novel chair folded for portability and storage.

FIG. 11 shows how the novel chair may be folded and stored. Preferably, the rope 29 is removed and stored separately to avoid tangling. By removing the turnbuckle 48, the lower part of the support member 17 may be swung upwardly on pivot 46 and folded alongside the rear side of frame bars 32, and the footrest is swung upwardly about the swivel joints in legs 20 of the frame at collar 40 to fold alongside of the front of the backrest 16. Thus folded, the chair may be leaned against a wall w in a closet or the like as shown.

It should be apparent that the novel exercise chair is so constructed that the resistance of the occupant's legs provide a controlled amount of resistance to the pull of his arms in such manner as to impart dynamic exercise to the arms, legs and torso, thereby stimulating cardiovascular therapy. Substantially all of the classic dynamic exercises may be effectively performed by the occupant.

The novel exercise chair is inexpensive to construct, requires no weights or power-driven parts, and is easily folded, transported and stored.

I claim:

1. A dynamic self-resisting exercise chair having a body-supporting frame, a support member having its upper end portion pivoted on said frame intermediate its ends and adapted when its lower end rests on a horizontal supporting surface to support said frame in upwardly inclined position, a base connected to the lower end of said frame and resting on said supporting surface, a footrest swiveled on said base for swinging toward and away from said frame, a crossbar mounted on the upper end of said frame with its ends projecting laterally from said frame, and rope and pulley means connecting the projecting ends of said crossbar and said footrest for transmitting a pulling force applied to the ends of said crossbar to said footrest to swing it rearwardly toward the frame, whereby an occupant supported on said frame can apply said pulling force with his arms and resist it by pushing his legs forwardly against said footrest.

2. A dynamic self-resisting exercise chair as defined in claim 1, wherein a seat is mounted on the upper end of said support member and a backrest is supported on said frame.

3. A dynamic self-resisting exercise chair as defined in claim 2, wherein the support member and the footrest are adapted to fold into close parallelism with said frame for portability and storage.

4. A dynamic self-resisting exercise chair as defined in claim 1, wherein means on the lower part of the frame limits the pivoting movement of the support member.

5. A dynamic self-resisting exercise chair as defined in claim 1, wherein the support member and the footrest are adapted to fold into close parallelism with said frame for portability and storage.

6. A dynamic self-resisting exercise chair as defined in claim 1, wherein said crossbar is adjustably mounted on the upper end of the frame.

7. A dynamic self-resisting exercise chair as defined in claim 6, wherein said rope and pulley means comprises pulleys on the ends of said crossbar and rope end portions trained over said pulleys.

8. A dynamic self-resisting exercise chair as defined in claim 7, wherein transverse legs are provided on the front of said footrest are adapted at their outer ends for selective connection with said rope means.

9. A dynamic self-resisting exercise chair as defined in claim 7, wherein the rope passes from said crossbar pulleys over pulleys on the sides of said support member to the footrest.

10. A dynamic self-resisting exercise chair as defined in claim 1, wherein the support member has laterally spaced bars straddling the frame and pivoted to the sides thereof.

11. A dynamic self-resisting exercise chair as defined in claim 1, wherein the frame has outturned transverse legs at its base and said footrest has bars extending rearwardly therefrom and terminating in inturned transverse legs swiveled at joints in the transverse legs of said frame.

12. A dynamic self-resisting exercise chair as defined in claim 11, wherein collars encircle the swivel joints to space the legs of the frame and the footrest above a supporting surface.

13. A dynamic self-resisting exercise chair as defined in claim 1, wherein said footrest has a central transverse bar and the rope and pulley means comprises pulleys on the ends of said crossbar and ropes having their end portions trained over said pulleys and extending therefrom forwardly and snubbed around the transverse bar on said footrest.

14. A dynamic self-resisting exercise chair as defined in claim 13, wherein the ropes pass from said crossbar pulleys over pulleys mounted on the sides of said support member.

* * * * *